United States Patent [19]

Oppenlaender et al.

[11] Patent Number: 4,675,025

[45] Date of Patent: Jun. 23, 1987

[54] AQUEOUS COAL DISPERSIONS

[75] Inventors: Knut Oppenlaender, Ludwigshafen; Karl Stork, Lampertheim; Friedrich Hovemann, Hockenheim; Erich Schwartz, Ludwigshafen, all of Fed. Rep. of Germany

[73] Assignee: BASF Aktiengesellschaft, Ludwigshafen, Fed. Rep. of Germany

[21] Appl. No.: 756,317

[22] Filed: Jul. 18, 1985

[30] Foreign Application Priority Data

Jul. 18, 1984 [DE] Fed. Rep. of Germany ..... 3426395

[51] Int. Cl.[4] ..... C10L 1/32

[52] U.S. Cl. ..... 44/51; 44/77; 252/312; 252/351; 252/353

[58] Field of Search ..... 44/51, 77; 525/507; 568/609; 252/312, 351, 353

[56] References Cited

U.S. PATENT DOCUMENTS

| | | | |
|---|---|---|---|
| 2,564,191 | 8/1951 | Groote et al. | 525/507 |
| 4,189,445 | 2/1980 | Oppenlaender et al. | 568/609 |
| 4,218,218 | 8/1980 | Daubach et al. | 8/550 |
| 4,358,293 | 11/1982 | Mark | 44/51 |
| 4,441,889 | 4/1984 | Mark | 44/51 |
| 4,457,762 | 7/1984 | Papalos et al. | 44/51 |
| 4,470,828 | 9/1984 | Yamamura et al. | 44/51 |
| 4,501,594 | 2/1985 | Marcellis et al. | 44/51 |
| 4,547,199 | 10/1985 | Boehmke | 44/51 |
| 4,552,568 | 11/1985 | Igarashi et al. | 44/51 |

FOREIGN PATENT DOCUMENTS 2005733 4/1979 United Kingdom .

*Primary Examiner*—William R. Dixon, Jr.
*Assistant Examiner*—Margaret B. Medley
*Attorney, Agent, or Firm*—Oblon, Fisher, Spivak, McClelland & Maier

[57] ABSTRACT

Pumpable free-flowing aqueous coal dispersions containing a special non-ionic dispersant which is a polyalkylene oxide bisphenol A derivative, and the use of the said dispersant in coal/water dispersions.

10 Claims, No Drawings

AQUEOUS COAL DISPERSIONS

BACKGROUND OF THE INVENTION

The present invention relates to pumpable, freeflowing aqueous coal dispersions which contain a special non-ionic dispersant and may or may not contain methanol, and to the use of a special non-ionic dispersant in coal/water dispersions.

Aqueous coal dispersions have recently become more important, particularly beccause they can be transported advantageously, for example in pipelines.

U.S. Pat. No. 4,358,293 discloses aqueous coal dispersions which contain relatively high molecular weight polyalkylene oxides as non-ionic surface-active dispersants. The compounds described include polyalkylene oxides of alkylphenols, such as nonylphenoxypolyethylene oxide containing more than 100 ethylene oxide units.

It has been found that the various surfactants are not particularly suitable for use in all cases, ie. they cannot be used for all types of coal. Moreover, some of the dispersants used to date are difficult to handle since they may dissolve very slowly in water and in some cases concentrated aqueous solutions cannot be prepared.

German Laid-Open Applications DOS No. 2,745,449 and DOS No. 2,751,519 disclose that polyalkylene oxide derivatives of bisphenol A derivatives, in particular in the sulfated form, are used as dispersants for disperse dyes and for optical brighteners which are sparingly soluble or insoluble in water. The stated dispersants are used in an amount of from 10 to 200% by weight, based on the amount of dispersed substances. Such an amount is completely unacceptable, for example, for aqueous coal dispersions.

SUMMARY OF THE INVENTION

It is an object of the present invention to provide novel dispersants for dispersions of various grades of coal.

We have found that this object is achieved, and that non-sulfated polyalkylene oxide bisphenol A derivatives are outstandingly suitable as dispersants for aqueous coal dispersions.

The present invention accordingly relates to pumpable free-flowing aqueous coal dispersions consisting of from 65 to 80, preferably from 70 to 75, % by weight of ground coal, from 35 to 20, preferably from 30 to 25, % by weight of water, from 1 to 60% by weight of which may be replaced with methanol, and conventional additives, the percentages in each case being based on the total weight, wherein the dispersion contains from 0.1 to 1.5, preferably from 0.2 to 1.0, % by weight, based on the total weight of the mixture, of a non-ionic dispersant of the formula I

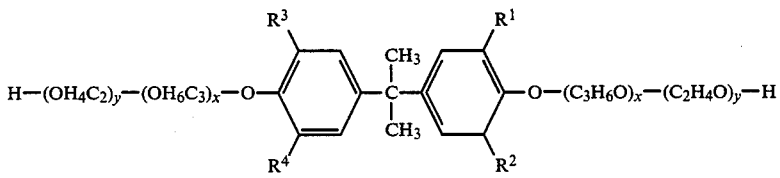

I where $R^1$ is

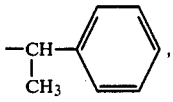

$R^2$, $R^3$ and $R^4$ are each hydrogen or $R^1$, x is 0 or from 5 to 400, preferably from 50 to 200, and y is from 80 to 800, preferably from 100 to 400, and the propylene oxide and ethylene oxide blocks may replace one another, or propylene oxide and ethylene oxide may be present in random distribution, and to the use of compounds of the formula I as dispersants in aqueous coal dispersions.

DETAILED DESCRIPTION OF THE PREFERRED EMBODIMENTS

The novel coal dispersions preferably contain ground coal from flotation processes, advantageously having a particle size distribution of less than 300 μm.

For example, in a particularly advantageous distribution, 100% of the particles are smaller than 300 μm, 80% smaller than 200 μm and 50% smaller than 50 μm.

Of course, coal having a high ash content is generally more difficult to disperse than that having a low ash content, a high ash content being about 8–12% and a low one less than 4% of ash. As a rule, the sulfur content of the preferably used coal from flotation processes is less than 1%.

The characteristics pumpability and free flow relate to the viscosity of the coal dispersion. As a rule, a dispersion having a viscosity of 2000 mPa.s is just freeflowing. In order to be able to effect transportation with very low energy consumption, the desired value in practice is 1000 mPa.s or less, the optimum range being <800 mPa.s. As shown in the Examples, the novel coal dispersions can be brought to this viscosity without difficulty.

As stated above, from 1 to 60% by weight of the water may be replaced with methanol, the addition of methanol serving to reduce the viscosity, ie. to improve the pumpability, of the coal dispersions at below 0° C., for example down to −20° C.

Moreover, the novel coal dispersions contain the conventional additives with which the skilled worker is familiar:

Antifoams, ie. conventional antifoams such as fatty acid polyoxyalkylates, eg. stearyl alcohol oxypropylate containing from 10 to 50 propylene oxide units or silicone oils, etc.; soluble inorganic salts as viscosity regulators, eg. ammonium chloride or carbonate, and alkali metal and alkaline earth metal chlorides and carbonates, in particular those of sodium and of calcium and magnesium, water-soluble phosphates and silicates, such as sodium hexametaphosphate or sodium metasilicate 9-hydrate; pH regulators, since a pH of from 8 to 10 is particularly advantageous for use in practice, eg. alkali metal and alkaline earth metal hydroxides, ammonium compounds and primary and secondary amines; stabilizers having a protective colloid action and/or a thickening action, suitable substances being polyethers (eg. polyethylene oxide, and copolymers of polyethylene oxide and polypropylene oxide), carboxymethylcellulose, hydroxyethylcellulose, polysaccharides (eg. alginates), polyalcohols, polyacrylates and copolymers of these. Other conventional additives are biocides.

The dispersants of the formula I are known per se, or may be prepared in a conventional manner by the processes described in German Laid-Open Applications DOS No. 2,745,449 and DOS No. 2,751,519.

Particularly preferred dispersants of the formula I are those in which x is 0 and y is from 80 to 400, and those in which x is from 50 to 150 and y is from 200 to 400.

The aqueous coal dispersions are prepared in a conventional manner. As a rule, a concentrated aqueous solution which contains from 40 to 70% by weight of a novel dispersant and, in contrast to some prior art dispersants, can easily be prepared is added to the required amount of water, and the ground coal and, if desired, other additives are added to the vigorously rotated mixture.

EXAMPLES

I.

Preparation of dispersants of the formula I (a) 228 g (1 mole) of 4,4'-dihydroxydiphenyldimethylmethane, 104 g (1 mole) of styrene and 1.66 g of p-toluenesulfonic acid as a catalyst were mixed at room temperature and then heated. An exothermic reaction took place at about 60° C., and the temperature increased to 120°-130° C. At this temperature, a further 1-3 moles of styrene may be added dropwise in the course of about 2 hours. Stirring was continued for 1 hour at 130° C. to complete the reaction. A reddish brown viscous oil was obtained, the yield being quantitative.

(b) 1% by weight of potassium hydroxide was added to the product obtained in stage (a), and propylene oxide and ethylene oxide were forced into the stirred mixture a little at a time, if desired in the reverse order, at from 120° to 130° C., so that the pressure did not exceed 8 bar.

II.

Application examples

Composition of the coal/water dispersions:

70% by weight of imported Polish coal (ground bituminous coal from a flotation process)

0.5% by weight of a dispersant of the formula I according to Table 1 and 29.5% by weight of water.

The dispersant was dissolved in the water, and the coal was added in the course of 3 minutes while stirring in a pilot-scale dissolver at about 1000-2000 rpm, and then dispersed for 20 minutes at 6500 rpm.

The viscosity [mPa.s] was determined at 20° C. and a shear velocity D of 220 $s^{-1}$, using a rotational viscometer.

TABLE 1

| Dispersant of the formula I | | | Viscosity, mPa · s (20° C., D = 220 $s^{-1}$) |
|---|---|---|---|
| $R^2$-$R^4$ | x | y | |
| $R^2$-$R^4$ = H | — | 100 | 410 |
| | — | 200 | 375 |

TABLE 1-continued

| Dispersant of the formula I | | | Viscosity, mPa · s (20° C., D = 220 $s^{-1}$) |
|---|---|---|---|
| $R^2$-$R^4$ | x | y | |
| | — | 400 | 390 |
| | 100 | 200 | 400 |
| | 100 | 400 | 360 |
| $R^1$ = $R^2$ | — | 100 | 400 |
| $R^3$, $R^4$ = H | — | 200 | 320 |
| | — | 400 | 425 |
| | 100 | 200 | 360 |
| | 100 | 400 | 390 |
| $R^2$-$R^4$ = $R^1$ | — | 100 | 385 |
| | — | 200 | 300 |
| | — | 400 | 430 |
| | 100 | 200 | 350 |
| | 100 | 400 | 330 |
| | 100 | 600 | 420 |
| Comparison: | | | |
| 1. Ethylenediamine containing 30% of propylene oxide and 70% of ethylene oxide, molecular weight 15,500 (Tetronic 1307) | | | 460 |
| 2. Block polymer of 20% of propylene oxide and 80% of ethylene oxide, molecular weight 8,500 (Pluronic 6800) | | | 960 |
| 3. Isononylphenol containing 200 ethylene oxide units | | | 710 |

The table shows that a comparison has been made with dispersants from U.S. Pat. No. 4,358,293.

The comparison shows that useful values are obtained with oxyalkylated ethylenediamine and nonylphenol, but the dispersants of the formula I are more advantageous in every case.

The oxyalkylated ethylenediamines are known to be difficult to handle and only 17% strength aqueous solutions can be prepared.

The novel dispersants give from 50 to 60% strength aqueous solutions without difficulty, which is a substantial advantage for industrial handling.

We claim:

1. A pumpable free-flowing aqueous coal dispersion, comprising:

(i) 65 to 80% by weight of ground coal;

(ii) 35 to 20% by weight of water, and (iii) 0.1 to 1.5% by weight of a non-ionic dispersant of the formula I (I)

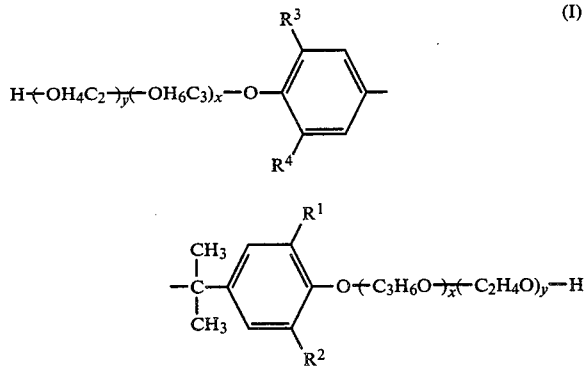

wherein $R_1$ is —CH(CH$_3$)—C$_6$H$_5$, and $R_2$, $R_3$ and $R_4$ are each independently a hydrogen atom or $R_1$, x is 0 or from 5 to 400, and y is from 80 to 800, wherein the propylene oxide and ethylene oxide blocks in formula I are as indicated in the formula, or wherein the propylene oxide and ethylene oxide blocks in formula I replace one another, or wherein the propylene oxide and ethylene oxide blocks in formula I are present in a random distribution; and, wherein the percentages are based on total weight.

2. The dispersion of claim 1, wherein x is 0 and y is from 80 to 400.

3. The dispersion of claim 1, wherein x is from 50 to 150 and y is from 200 to 400.

4. The dispersion of claim 1, comprising from 0.2 to 1% by weight of the said non-ionic dispersant of formula I.

5. The dispersion of claim 1, wherein the said ground coal has a particle size distribution of less than 300 μm.

6. The dispersion of claim 1, wherein 100% of the particles of the said ground coal have a particle size of less than 300 μm, 80% of the particles of the said ground coal have a particle size less than 200 μm, and 50% of the ground coal has a particle size of less than 50 μm.

7. The dispersion of claim 1, wherein the said ground coal has a sulfur content of less than 1%.

8. The dispersion of claim 1, said dispersion comprising an additive, said additive being at least one member selected from the group consisting of antifoam agents, viscosity regulators, water-soluble phosphates, water-soluble silicates, pH regulators, ammonium compounds, primary amines, secondary amines, stabilizers having a protective colloid action, stabilizers having a thickening action and biocides.

9. The dispersion of claim 1, wherein the said dispersion has a pH of from 8 to 10.

10. A pumpable free-flowing aqueous coal dispersion, comprising:

(i) 65 to 80% by weight of ground coal;

(ii) 35–20% by weight of a mixture of water and methanol wherein the methanol is present in an amount of 1 to 60% by weight of the said mixture; and (iii) 0.1 to 1.5% by weight of a non-ionic dispersant of the formula I

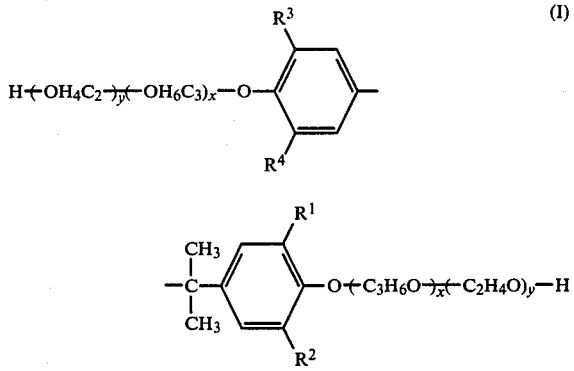

wherein $R_1$ is —CH($CH_3$)—$C_6H_5$, and $R_2$, $R_3$ and $R_4$ are each independently a hydrogen atom or $R_1$, x is 0 or from 5 to 400, and y is from 80 to 800, wherein the propylene oxide and ethylene oxide blocks in formula I are as indicated in the formula, or wherein the propylene oxide and ethylene oxide blocks in formula I replace one another, or wherein the propylene oxide and ethylene oxide blocks in formula I are present in a random distribution; and, wherein the percentages are based on total weight.

* * * * *